US008712308B2

(12) United States Patent
Ikari et al.

(10) Patent No.: US 8,712,308 B2
(45) Date of Patent: Apr. 29, 2014

(54) LUBRICANT COATING DEVICE AND IMAGE FORMING APPARATUS

(75) Inventors: Ryoei Ikari, Koshigaya (JP); Seiko Itagaki, Hachioji (JP); Kazutoshi Kobayashi, Hachioji (JP); Shunichi Takaya, Hino (JP); Tatsuya Furuta, Chofu (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/450,619

(22) Filed: Apr. 19, 2012

(65) Prior Publication Data

US 2012/0275837 A1 Nov. 1, 2012

(30) Foreign Application Priority Data

Apr. 28, 2011 (JP) ..... 2011-101601

(51) Int. Cl.
*G03G 21/00* (2006.01)

(52) U.S. Cl.
USPC ..... 399/346

(58) Field of Classification Search
USPC ..... 399/346, 159
See application file for complete search history.

(56) References Cited

U.S. PATENT DOCUMENTS

| | | | | |
|---|---|---|---|---|
| 7,209,699 | B2 * | 4/2007 | Yamaguchi et al. | 399/346 |
| 7,693,475 | B2 * | 4/2010 | Shakuto et al. | 399/346 |
| 8,315,535 | B2 * | 11/2012 | Shintani et al. | 399/94 |
| 2008/0292361 | A1 * | 11/2008 | Seshita et al. | 399/252 |
| 2010/0034570 | A1 * | 2/2010 | Hatakeyama et al. | 399/346 |
| 2010/0189461 | A1 | 7/2010 | Shintani et al. | |
| 2011/0058859 | A1 * | 3/2011 | Nakamatsu et al. | 399/299 |
| 2011/0206431 | A1 * | 8/2011 | Tawada et al. | 399/346 |

FOREIGN PATENT DOCUMENTS

| | | | |
|---|---|---|---|
| JP | 2009169237 A | * | 7/2009 |
| JP | 2010038934 A | | 2/2010 |
| JP | 2010066567 A | * | 3/2010 |
| JP | 2010169899 A | | 8/2010 |
| JP | 2010-191110 A | | 9/2010 |

OTHER PUBLICATIONS

Notification of Reasons for Refusal for Japanese Application No. 2011-101601; Date of Mailing : May 14, 2013, with English Translation.

* cited by examiner

*Primary Examiner* — Robert Beatty
(74) *Attorney, Agent, or Firm* — Cantor Colburn LLP

(57) ABSTRACT

A lubricant coating device related to the present invention is characterized in that it comprises a lubricant supply unit 12 which supplies a lubricant 11 onto an outer peripheral surface of an image carrier 1 that is driven to rotate and a lubricant smoothing unit 13 which is disposed on the downstream side in a rotating direction of the image carrier 1 of the lubricant supply unit 12 and smoothes the lubricant 11 supplied onto the outer peripheral surface. In the lubricant coating device, the lubricant smoothing unit 13 rotates while being in surface contact with the outer peripheral surface of the image carrier 1 and thereby smoothes the lubricant 11 supplied onto the image carrier 1 by the lubricant supply unit 12.

8 Claims, 4 Drawing Sheets

20

20'

LUBRICANT COATING DEVICE AND IMAGE FORMING APPARATUS

CROSS-REFERENCE TO RELATED APPLICATION

This application is based on Japanese Patent Application No. 2011-101601 filed on Apr. 28, 2011, the contents of which are incorporated herein by reference.

BACKGROUND

1. Technical Field

This invention relates to a lubricant coating device and an image forming apparatus.

2. Description of Related Art

In an image forming apparatus using an electrophotographic system, a lubricant is used in order to reduce the friction between an image carrier and a cleaning blade which cleans a surface of the image carrier as well as to effectively perform cleaning. A solid-state lubricant, after being scraped away by a lubricant brush, is adhered onto the surface of the image carrier by the lubricant brush and is then pushed and spread out on the image carrier by a smoothing blade. The smoothing blade is fixed and pressed against the image carrier with a certain pressure and smoothes the lubricant on the image carrier so as to push and spread out the lubricant while the image carrier is driven to rotate around a rotation shaft.

As an art associated with the above issue, there has been a technique of providing another lubricant brush disposed in the downstream of a lubricant brush (for example, see Japanese Patent Publication No. 2010-191110). According to this technique, a lubricant scattered from the first lubricant brush is received by the second lubricant brush, and the lubricant gets adhered to an image carrier by the second lubricant brush; therefore, the lubricant that could not have been adhered by the first lubricant brush can be adhered to the image carrier. So, the waste of the lubricant is reduced.

However, in the technique disclosed in the above Japanese Patent Publication, although the lubricant can be supplied to the image carrier by the two lubricant brushes without wasting the lubricant, the supplied lubricant is pushed and spread out on the surface of the image carrier by a smoothing blade provided in the downstream of the two lubricant brushes. Since the smoothing blade scrapes away the lubricant more than necessary, the lubricant ends up being wasted anyway. Meanwhile, if an abutting force of the smoothing blade against the image carrier is reduced in order to reduce the lubricant that is scraped away and wasted, a pressure for smoothing the lubricant is reduced; thus, uniform coating of the lubricant cannot be achieved. Accordingly, transfer unevenness of toner results due to coating unevenness of lubricant on the image carrier, whereby printing quality is lowered.

See Japanese Patent Publication No. 2010-191110.

SUMMARY

To achieve at least one of the abovementioned objects, a lubricant coating device reflecting on aspect of the present invention comprises a lubricant supply unit and a lubricant smoothing unit. The lubricant supply unit supplies a lubricant on an outer peripheral surface of an image carrier that is driven to rotate. The lubricant smoothing unit is disposed on the downstream side in a rotating direction of the image carrier of the lubricant supply unit and smoothes the lubricant supplied onto the outer peripheral surface. Further, the lubricant smoothing unit rotates while being in surface contact with the outer peripheral surface of the image carrier and thereby smoothes out the lubricant supplied onto the image carrier by the lubricant supply unit.

In the lubricant coating device, it is preferable that the lubricant smoothing unit is driven to rotate at a circumferential speed different from the circumferential speed of the image carrier.

In the lubricant coating device, it is preferable that the lubricant smoothing unit is driven to rotate at a circumferential speed higher than the circumferential speed of the image carrier.

In the lubricant coating device, it is preferable that the lubricant smoothing unit is rotated and driven so that a surface of the lubricant smoothing unit and a surface of the image carrier, at a portion where the lubricant smoothing unit and the image carrier are in surface contact with each other, advance in the same direction.

It is preferable that the lubricant coating device further includes a heating unit, a temperature detecting unit, and a temperature control unit. The heating unit heats the lubricant smoothing unit. The temperature detecting unit detects a temperature of the lubricant smoothing unit. The temperature control unit controls the heating unit so as to keep the temperature of the lubricant smoothing unit at a predetermined temperature based on the temperature detection results obtained by the temperature detecting unit.

In the lubricant coating device, it is preferable that the temperature control unit controls the temperature of the lubricant smoothing unit to 40° C. to 60° C.

In the lubricant coating device, it is preferable that a surface layer of the lubricant smoothing unit is formed of an elastic body.

In the lubricant coating device, it is preferable that a surface of the elastic body is constituted of a releasing member with a releasing characteristics.

In the lubricant coating device, it is preferable that the releasing member is formed of a fluorine-contained resin.

The objects, features, and characteristics of this invention other than those set forth above will become apparent from the description given herein below with reference to preferred embodiments illustrated in the accompanying drawings.

DETAILED DESCRIPTION

Figure 1:
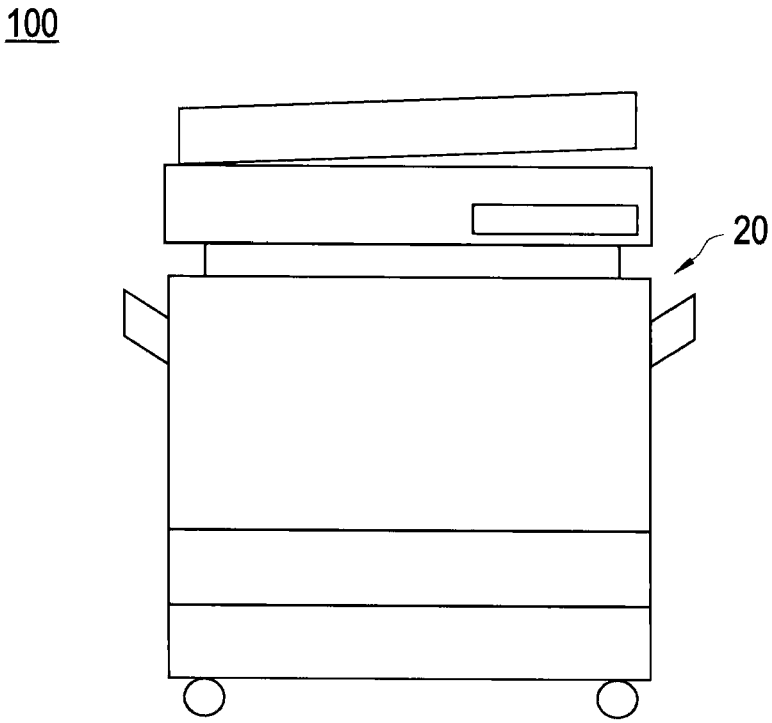
FIG. 1 is an external view schematically showing a front side of an image forming apparatus according to an embodiment of the present invention.

The embodiments of the present invention will be described below with reference to the accompanying drawings. In the description of the drawings, the same components are denoted by the same reference symbols, and redundant explanations thereof are omitted. Moreover, the dimensional ratios in the drawings are exaggerated for the convenience of description and thus are not always equal to the actual ratios.

Figure 2:
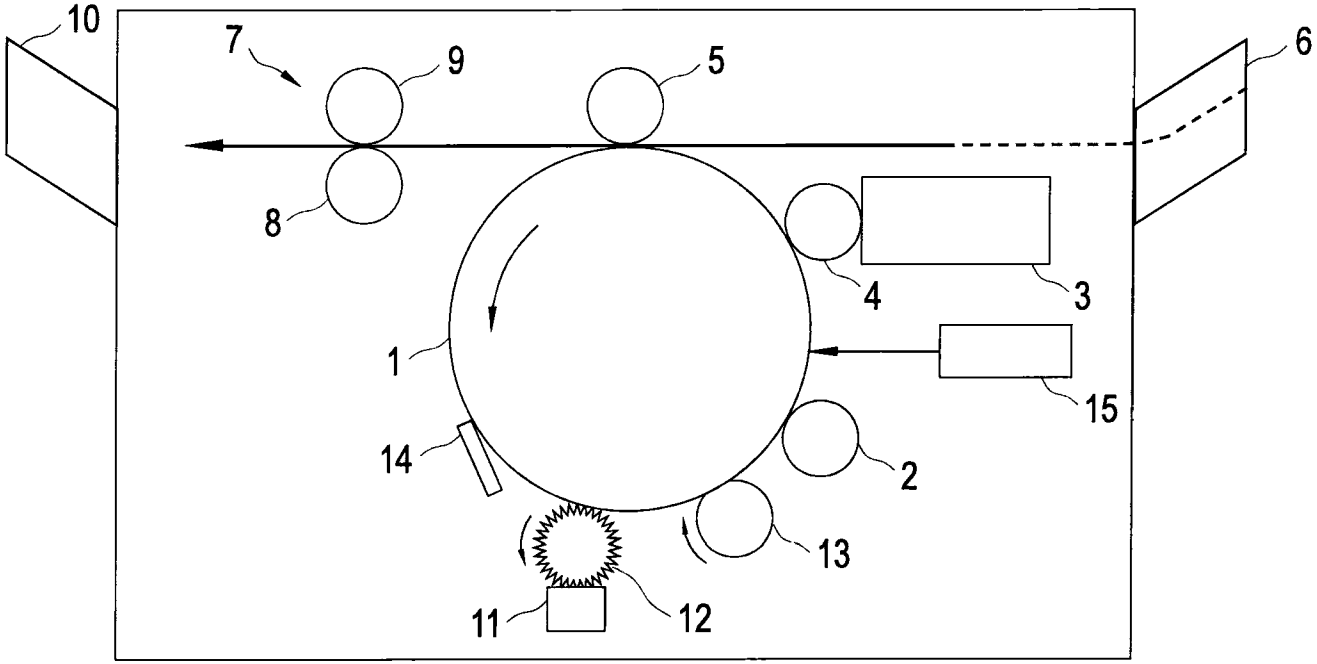
FIG. 2 is a cross-sectional view schematically showing a configuration of an image forming unit provided with a lubricant coating device according to the first embodiment of the present invention.
Figure 3:
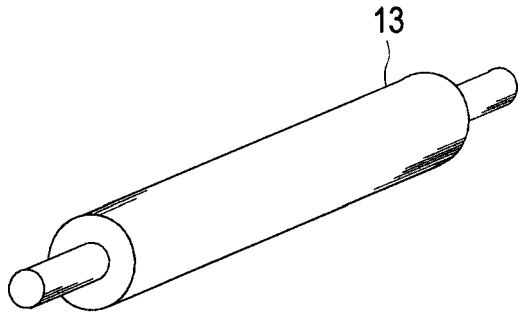
FIG. 3 is a perspective view showing a rotating roller according to the present embodiment.

FIG. 1 is an external view schematically showing a front side of an image forming apparatus according to an embodiment of the present invention. FIG. 2 is a cross-sectional view schematically showing a configuration of an image forming unit provided with a lubricant coating device according to the first embodiment of the present invention. FIG. 3 is a perspective view showing a rotating roller according to the present embodiment.

An image forming apparatus 100 shown in FIG. 1 is a copier, a printer, a fax machine, or the like and prints image data with the use of an electrophotographic imaging process on a recording medium such as a sheet of paper. The image forming apparatus 100 is provided with an image forming unit 20 for forming an image. Also, the image forming apparatus 100 may be suitably provided with an ADF (Automatic Document Feeder), an image reading unit, an operating unit, and so on.

As shown in FIG. 2, the image forming unit 20 is provided with a photosensitive drum 1, a charging roller 2, a toner holding unit 3, a developing roller 4, a transfer roller 5, a fixing device 7, and a print head 15. The image forming unit 20 is provided with a paper feeding tray 6 and a paper discharge tray 10.

When the image forming unit 20 receives image data, the surface of the photosensitive drum 1 is uniformly charged by the charging roller 2 and then exposed by the print head 15 based on the received image data, whereby an electrostatic latent image portion is formed on the surface of the photosensitive drum 1 to make toner supplied from the toner holding unit 3 adhere to the electrostatic latent image portion by the developing roller 4 and to form a toner image. Subsequently, the image forming unit 20 transfers the toner image formed on the photosensitive drum 1 onto a sheet of paper conveyed from the paper feeding tray 6 by the transfer roller 5, and the toner on the sheet is fixed by the fixing device 7. The sheet printed thereby is discharged onto the paper discharge tray 10.

The fixing device 7 has a heat roller 8 which is heated and a pressing roller 9 which is in press contact against the heat roller 8. When the sheet on which the toner is transferred is guided to between the heat roller 8 and the pressure roller 9, the toner is heated and pressed between the both rollers 8 and 9. And, the transferred toner is fixed onto the sheet.

Furthermore, the image forming unit 20 according to the present embodiment is provided with the photosensitive drum 1, a lubricant 11, a lubricant brush 12, a rotating roller 13, and a cleaning blade 14.

The solid-state lubricant 11 is a lubricant agent used for reducing friction between the photosensitive drum 1 and the cleaning blade 14 to remove excess toner adhered to the photosensitive drum 1. Specifically, the lubricant 11 is coated on the photosensitive drum 1, whereby the lubricant 11 functions to reduce an adhering force of the excess toner to the photosensitive drum 1 and actualize a good cleaning of the photosensitive drum 1. As a result, the lubricant 11 prevents the occurrence of filming on the surface of the photosensitive drum 1. Also, by being coated on the photosensitive drum 1, the lubricant 11 reduces the friction between the photosensitive drum 1 and the cleaning blade 14 and prevents the surface of the photosensitive drum 1 from becoming rough. Also, by increasing the amount of the lubricant 11 to be applied, the cleanliness of the photosensitive drum 1 can be improved. Here, the lubricant 11 can be produced from zinc stearate (ZnSt), calcium stearate (CaSt), and so on.

The lubricant brush 12, as a lubricant supply unit, supplies the lubricant 11 to the photosensitive drum 1. For the lubricant brush 12, brush fibers made from acrylic carbon and so on are implanted around a cored bar in a desired pile density, pile diameter, and pile length. The lubricant brush 12 is driven to rotate around the cored bar as a rotation shaft while being in contact with the solid-state lubricant 11, whereby the lubricant brush 12 scrapes away the solid-state lubricant 11 by its brush and make the scraped lubricant 11 adhered onto the photosensitive drum 1. Hereat, as shown in FIG. 2, the lubricant brush 12 is rotated in a direction, such that at the contacting portions between the photosensitive drum 1 and the brush unit of the lubricant brush 12, the surfaces of the photosensitive drum 1 and the brush of the lubricant brush 12 advance in opposite directions relative to each other (hereafter, this rotating direction is referred to as a reverse rotation). Or, the lubricant brush 12 may be rotated in the direction opposite to the above rotating direction (hereafter, this rotating direction is referred to as a forward rotation). Also, by increasing the rotation speed of the lubricant brush 12, the supply amount of the lubricant 11 to the photosensitive drum 1 can be increased. Also, by increasing the pressing force of the lubricant brush 12 against the lubricant 11, and so on, the supply amount of the lubricant 11 to the photosensitive drum 1 can be increased.

The rotating roller 13, as a lubricant smoothing unit, smoothes the lubricant 11 on the surface of the photosensitive drum 1, which was adhered onto the photosensitive drum 1 by the lubricant brush 12. Specifically, the rotating roller 13 is arranged to be in press contact against the photosensitive drum 1 and in surface contact with the photosensitive drum 1. Namely, a nip portion is formed between the photosensitive drum 1 and the rotating roller 13. The rotating roller 13 smoothes the lubricant on the surface of the photosensitive drum 1 while the photosensitive drum 1 is rotating. Also, as shown in FIG. 3, the rotating roller 13 may have, around a cylindrical cored bar, a surface layer formed of an elastic member such as silicone rubber, fluorinated rubber, or the like which is formed in a desired thickness. The surface layer of the rotating roller is formed of an elastic body, whereby the lubricant 11 on the photosensitive drum 1 can be prevented from being scraped away while the surface of the photosensitive drum 1 can be protected at the same time. Also, the rotating roller 13 can be configured to be driven to rotate around the cored bar as the rotation shaft. The rotating roller 13 is rotated at a rotation speed different from the rotation speed of the photosensitive drum 1, whereby the rotating roller 13 can smooth the lubricant on the photosensitive drum 1 more effectively. Preferably, the rotating roller 13 is driven in the forward rotation at a speed 1.1 to 2.0 times the rotation speed of the photosensitive drum 1. Also, the rotating roller 13 may be driven in the reverse rotation, wherein the rotating direction is opposite to the rotating direction of the photosensitive drum 1.

The surface of the rotating roller 13 may be coated by a fluorine-contained resin such as PFA (tetrafluoroethylene/perfluoroalkyl vibyl ether copolymer). By virtue of such coating, the rotating roller 13 can have high release characteristics, and toner etc. on the surface of the photosensitive drum 1 can be prevented from being stuck to the surface of the rotating roller 13.

The cleaning blade 14 removes impurities on the surface of the photosensitive drum 1. Specifically, the cleaning blade 14 removes excess tonner which has not been transferred as well as impurities such as ion products produced by charging the photosensitive drum 1 and so on. Also, the cleaning blade 14 is formed of urethane rubber etc. and, as shown in FIG. 2, fixed and arranged so as to form an acute angle with the surface of the photosensitive drum 1. The abutting angle, pressure, length, and so on upon abutting of the cleaning blade 14 against the photosensitive drum 1 can be arbitrarily set.

Meanwhile, the above components of the image forming unit 20 are suitably controlled by a controller (not illustrated). Also, the image forming unit 20 may include components other than the components mentioned above and may not include some of the components mentioned above.

The effects related to the present embodiment will be described later with reference to the following Table 1.

Next, an image forming apparatus according to the second embodiment of the present invention will be described with reference to FIG. 4.

Figure 4:
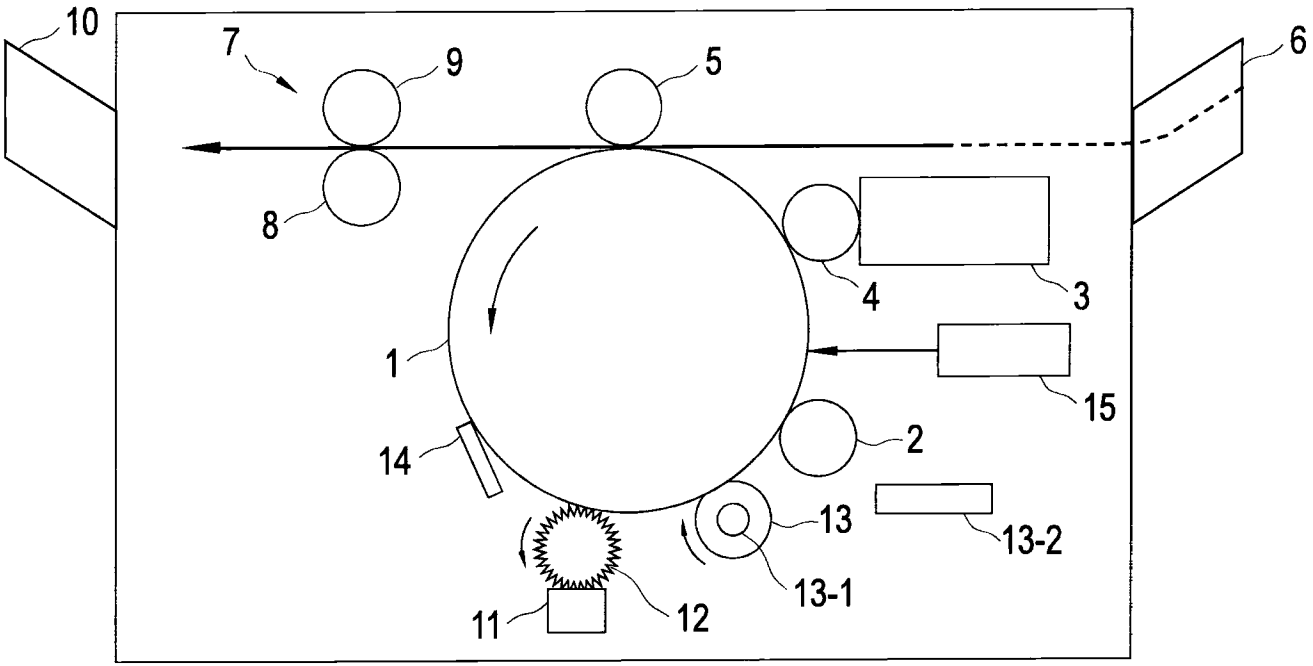
FIG. 4 is a cross-sectional view schematically showing a configuration of an image forming unit provided with a lubricant coating device according to the second embodiment of the present invention.

FIG. 4 is a cross-sectional view schematically showing a configuration of an image forming unit according to the second embodiment of the present invention.

As shown in FIG. 4, an image forming apparatus 20' according to the second embodiment of the present invention has the configuration of the first embodiment and is further provided with a heating Unit 13-1 as well as a temperature detecting unit 13-2, wherein the temperature of a rotating roller 13 is controlled. The heating unit 13-1 is formed at a cored bar unit of the rotating roller 13, is a ceramic heater for example, and heats the rotating roller 13 based on the instruction from the controller. The temperature detecting unit 13-2 is disposed near the rotating roller 13, is a noncontact sensor for example, and transmits the detected temperature to the controller. The controller controls the surface temperature of the rotating roller 13 to 40° C. to 60° C., depending on the type of toner used. This temperature is a temperature at which the toner is slightly softened and thus more easily settles to the surface of the image carrier. By virtue of the use of the heating unit 13-1 and the temperature detecting unit 13-2, the surface temperature of the rotating roller 13 can be controlled to keep a predetermined temperature and smooth the lubricant 11 on the photosensitive drum 1 more effectively.

The effects according to the second embodiment of the present invention will also be described later with reference to the following Table 1.

Next, experimental results (first and second Examples) according to the lubricant coating device according to the first and second embodiments of the present invention as well as experimental results (Comparative Example) according to the lubricant coating device having a smoothing blade as a Comparative Example will be described with reference to the Table 1.

The following Table 1 shows the results of examination and evaluation of image quality in printing and the uniformity of a lubricant coated on a photosensitive drum; a transverse band chart with a printing rate of 5% was printed as a performance chart on a hundred thousand A4 sheets of printing paper using the lubricant coating apparatus according to the first and second embodiments as well as the lubricant coating apparatus of the Comparative Example. The uniformity of the lubricant is an indicator showing the degree of the lubricant uniformly coated on the photosensitive drum and was evaluated by measuring the frication coefficient on the surface of the photosensitive drum coated with the lubricant. The more uniformly the lubricant is coated, the lower the friction coefficient is.

First, the configuration of the lubricant coating devices used in the Comparative Example as well as the first and second Examples will be described in detail.

As the common setting conditions in all experimental examples, a photosensitive drum, a cleaning blade, a lubricant, and a lubricant brush were commonly used. Specifically, the photosensitive drum was set to an outer diameter of 60 mm and its circumferential speed to 300 mm/s. The lubricant was formed of solid-state ZnSt and had a size of 5×8×330 mm. The brush was formed of acrylic carbon and had a pile density of 150 kF/inch$^2$, a pile diameter of 3d, a cored bar diameter of 6 mm, and an outer diameter of 12 mm. And, the rotating direction was set to the reverse rotation relative to the rotating direction of the photosensitive drum. Also, regarding an external environment, the temperature was 20° C., and the humidity was 50%.

In the Comparative Example, the photosensitive drum, the cleaning blade, the lubricant, and the lubricant brush mentioned above were used. In addition, a smoothing blade was used to smooth the lubricant on the photosensitive drum. The smoothing blade was formed of urethane rubber and formed with a thickness of 1.6 mm, a free length of 7 mm, and the same width as the width of the photosensitive drum. Also, for the smoothing blade, the abutting pressure and the abutting angle against the photosensitive drum were set respectively to 30 N/m and 50°.

In the Example 1, in order to smooth the lubricant, the rotating roller was used instead of the smoothing blade of the Comparative Example. For the rotating roller, the diameter of the cored bar was 6 mm, and the thickness of the elastic layer as a surface layer was 3 mm. The elastic layer was formed of silicone rubber, and the hardness of silicone rubber measured by the Asker C was 50°. The surface of the elastic body was coated with PFA. Also, the rotating roller was pressed against the photosensitive drum with strength of 10N. Here, the rotating roller and the photosensitive drum were installed so as to parallel to each other. Also, the rotating direction of the rotating roller was set to the forward rotation with respect to the rotating direction of the photosensitive drum. And, the circumferential speed of the rotating roller was 1.1 times the circumferential speed of the photosensitive drum; namely, the circumferential speed of the rotating roller was 330 mm/s.

In the Example 2, in addition to the configurations and conditions of those used in the Example 1, the temperature control device was used. Specifically, in the Example 2, the temperature control device was provided at the cored bar portion of the rotating roller, and temperature control was performed so as to set the lower limit of the surface temperature of the rotating roller to 40° C. and the upper limit to 50-60° C. Also, the surface temperature of the rotating roller was measured by a noncontact temperature sensor.

Next, setting parameters and evaluation items shown in the Table 1 will be described.

"Circumferential speed of lubricant brush" shows the circumferential speed of the rotated and driven lubricant brush. The circumferential speed of the lubricant brush was adjusted in order to adjust the amount of the lubricant supplied to the photosensitive drum. For example, by increasing the circumferential speed of the lubricant brush, the supply amount of the lubricant could be increased.

"Lubricant consumption" shows an amount of the lubricant scraped away by the lubricant brush. The lubricant consumption can also be adjusted by adjusting the pressing force of the lubricant brush against the lubricant. As described above while adjusting the pressing force, the lubricant consumption was adjusted by adjusting the circumferential speed of the lubricant brush.

"Photosensitive drum surface roughness" is an indicator showing the surface roughness of the photosensitive drum after the implementation of the experiment and shows the measurement results of Rz. "⊙" shows that Rz is less than 0.5 μm, "○" shows that Rz is less than 0.5 to 1.0 μm, and "Δ" shows that Rz is equal to or more than 1.0 μm.

In the evaluation of "halftone image quality", the performance chart was visually checked, and vertical streaks which appear as a printing failure on the performance chart were used to evaluate. "⊙" shows that the vertical streak did not appear at all or almost at all. "○" shows that a few vertical streaks appeared. "Δ" shows that the vertical streaks could have been seen on the performance chart. "x" shows that many vertical streaks could have been clearly seen on the performance chart, and that the halftone image quality is unsuitable for use.

"Average value of friction coefficient of photosensitive drum" is an average value obtained by measuring the friction coefficient of the surface of the photosensitive drum coated with the lubricant. As described above, the friction coefficient average value of the photosensitive drum is an indicator showing whether the lubricant is uniformly coated on the photosensitive drum or not. The lower the friction coefficient average value of the photosensitive drum is, the better the lubricant was coated on the photosensitive drum.

"Standard deviation of photosensitive drum friction coefficient in the longitudinal direction" shows a standard deviation of the photosensitive drum of the measured friction coefficient of the photosensitive drum in the longitudinal direction. The lower the standard deviation is, the more uniformly the lubricant was coated on the entire photosensitive drum.

image quality was not suitable for use. It can be considered that the surface of the photosensitive drum was worn down by using the smoothing blade, whereby the surface of the photosensitive drum became coarse. Also, it can be considered that the reason why the halftone image quality resulted in poor quality is that since a highly accurate toner image could not be formed due to the worn photosensitive drum surface, and since the lubricant could not be coated uniformly by the smoothing blade, the coating unevenness of the lubricant caused the transfer unevenness and thus lowered the image quality.

In the Example 1, when the circumferential speed of the lubricant brush was 150 mm/s, and when the lubricant consumption was 0.7 g, the good results were obtained. It can be considered that compared to the Comparative Example, even though only a small amount of the lubricant was consumed, and the circumferential speed of the lubricant brush was not faster in the Example 1, the lubricant could be coated uniformly since the rotating roller was used; therefore, the wear of the photosensitive drum surface could have been avoided under the above conditions. On the other hand, if a sufficient amount of the lubricant was not supplied, when the lubricant consumption was 0.5 g, and when the circumferential speed of the lubricant brush was 100 mm/s, and when the lubricant consumption was 0.3 g, the results did not turn out to be good. However, as seen in the friction coefficient average value of the photosensitive drum surface and the friction coefficient standard deviation, by virtue of using the rotating roller, the

TABLE 1

| | Comparative Example | | Example 1 | | | | | | | | Example 2 | | | | |
|---|---|---|---|---|---|---|---|---|---|---|---|---|---|---|---|
| Circumferential speed of lubricant brush (mm/s) | 200 | 150 | 150 | 100 | 150 | 100 | 150 | 100 | 150 | 100 | 150 | 100 | 150 | 100 |
| Lubricant consumption (g) | 1.0 | 0.7 | 0.7 | 0.7 | 0.5 | 0.5 | 0.3 | 0.3 | 0.7 | 0.7 | 0.5 | 0.5 | 0.3 | 0.3 |
| Photosensitive drum surface roughness | Δ | Δ | ⊙ | ○ | ○ | Δ | Δ | Δ | ⊙ | ⊙ | ⊙ | ○ | ○ | ○ |
| Halftone image quality | Δ | X | ⊙ | ○ | ○ | Δ | Δ | Δ | ⊙ | ⊙ | ⊙ | ○ | ○ | ○ |
| Average value of friction coefficient of photo-sensitive drum | 0.27 | 0.30 | 0.17 | 0.19 | 0.20 | 0.23 | 0.24 | 0.25 | 0.15 | 0.17 | 0.18 | 0.20 | 0.21 | 0.22 |
| Standard deviation of photosensitive drum friction coefficient in the longitudinal direction | 0.02 | 0.02 | 0.01 | 0.01 | 0.01 | 0.02 | 0.02 | 0.02 | 0.01 | 0.01 | 0.01 | 0.01 | 0.01 | 0.01 |

Next, the results of the experimental examples will be described in detail.

As shown in the Table 1, in the Comparative Example, the lubricant consumption was larger than in the Examples 1 and 2. Moreover, although the circumferential speed of the lubricant brush was increased (200 mm/s) to supply a relatively large amount of the lubricant to the photosensitive drum, the Comparative Example performed poorly in terms of the both indicators of the surface roughness of the photosensitive drum and the halftone image quality. Also, when the lubricant of the amount (0.7 g) equal to the maximum lubricant usage amount in the Example 1 was coated, the level of the halftone uniformity of the lubricant in the Example 1 performed better than in the Comparative Example.

In the Example 2, when the lubricant consumption was 0.7 g, and when the lubricant consumption was 0.5 g with the circumferential speed of the lubricant brush 150 mm/s, the results turned out to be good. Further, when the lubricant consumption was 0.5 g with the circumferential speed of the lubricant brush 100 mm/s, and when the lubricant consumption was 0.3 g, the results turned out to be relatively better in comparison with the Example 1. It can be considered that by virtue of using the rotating roller provided with the temperature control unit according to one embodiment of the present invention, toner in a slightly softened state was coated on an image carrier. And, therefore, the toner was more easily settled to the image carrier surface; so the lubricant was coated on the photosensitive drum more uniformly.

In the above example, the circumferential speed of the rotating roller was set to 1.1 times the circumferential speed of the photosensitive drum. However, even if the rotating roller was controlled to different circumferential speed, substantially the same results were obtained. Further, even if the surface layer of the rotating roller was formed of a fluorinated rubber, substantially the same results were obtained.

As described above, according to the first embodiment of the present invention, by using the rotating roller, the lubricant can be coated on the photosensitive drum more uniformly. Also, by using the surface layer of the rotating roller formed of an elastic body, the lubricant can be coated on the photosensitive drum uniformly without scraping the lubricant away—that is, without wasting the lubricant. Further, by rotating the rotating roller at the circumferential speed different from the circumferential speed of the photosensitive drum, the lubricant can be coated on the photosensitive drum more efficiently. Furthermore, by forming the surface of the elastic body from a material with high release characteristics, the lubricant can be smoothed more effectively while preventing the lubricant and so on from being adhered to the rotating roller. Furthermore, according to the first embodiment, the lubricant can be coated while preventing the surface of the photosensitive drum from becoming worn. Accordingly, printing with better quality can be achieved.

Also, according to the second embodiment of the present invention, in addition to the effects of the above first embodiment, the temperature of the rotating roller is controlled to no less than 40° C., whereby the lubricant can be uniformly coated on the photosensitive drum surface more effectively.

The present invention is not limited to only the above embodiments, and various modifications and alterations can be made within the scope of the invention.

For example, the surface layer of the rotating roller in the above embodiment was formed of an elastic body having a hardness of 50°. However, this invention is not limited thereto. Any hardness may be set.

In the above embodiment, although the temperature control was performed by using a heater, a thermostat, and a noncontact temperature sensor, any known temperature controller may be used. For example, a thermistor may be used instead of a noncontact temperature sensor. Also, the friction coefficient can be measured by any measuring instrument. For example, the friction coefficient can be measured by a force gauge, a load cell, and so on.

Also, the photosensitive drum, the cleaning blade, the lubricant, the lubricant brush, the rotating roller, and so on may be disposed in any manner. The abutting angle of the cleaning blade and the pressure contact force of the rotating roller can be arbitrarily set.

In the above embodiments, although the surface of the rotating roller is coated with PFA, this invention is not limited thereto. Other materials may be used.

What is claimed is:

1. A lubricant coating device comprising:

a lubricant supply unit which supplies a lubricant to an outer peripheral surface of an image carrier that is driven to rotate;

a lubricant smoothing unit which is disposed on the downstream side in a rotating direction of the image carrier relative to the lubricant supply unit and smoothes the lubricant supplied to the outer peripheral surface, a heating unit which heats the lubricant smoothing unit;

a temperature detecting unit which detects a temperature of the lubricant smoothing unit; and a temperature control unit which controls the heating unit so as to keep the temperature of the lubricant smoothing unit at a predetermined temperature based on the temperature detection results obtained by the temperature detecting unit;

wherein the lubricant smoothing unit rotates while being in surface contact with the outer peripheral surface of the image carrier and thereby smoothes the lubricant supplied onto the image carrier by the lubricant supply unit; and the temperature control unit controls the temperature of the lubricant smoothing unit to 40° C. to 60° C.

2. The lubricant coating device as claimed in claim 1, wherein the lubricant smoothing unit is driven to rotate at a circumferential speed different from the circumferential speed of the image carrier.

3. The lubricant coating device as claimed in claim 2, wherein the lubricant smoothing unit is driven to rotate at a higher circumferential speed than the circumferential speed of the image carrier.

4. The lubricant coating device as claimed in claim 1, wherein the lubricant smoothing unit is driven to rotate so that a surface of the lubricant smoothing unit and a surface of the image carrier, at a portion where the lubricant smoothing unit and the image carrier are in surface contact with each other, advance in the same direction.

5. The lubricant coating device as claimed in claim 1, wherein a surface layer of the lubricant smoothing unit is formed of an elastic body.

6. The lubricant coating device as claimed in claim 5, wherein the surface of the elastic body is formed of a releasing member with a releasing characteristics.

7. The lubricant coating device as claimed in claim 6, wherein the releasing member is formed of a fluorine-contained resin.

8. An image forming apparatus comprising:

a toner image forming unit which forms a toner image on the image carrier;

a cleaning unit which cleans toner remaining on the image carrier after transfer of the toner image to a recording medium; and the lubricant coating device as claimed in claim 1.

* * * * *